US005831496A

United States Patent [19]

Sonoda et al.

[11] Patent Number: 5,831,496

[45] Date of Patent: Nov. 3, 1998

[54] DIELECTRIC FILTER

[75] Inventors: Tomiya Sonoda, Mukoh; Eiichi Kobayashi, Nagaokakyo, both of Japan

[73] Assignee: Murata Manufacturing Co., Ltd., Japan

[21] Appl. No.: 705,770

[22] Filed: Aug. 30, 1996

[30] Foreign Application Priority Data

Sep. 1, 1995 [JP] Japan ..... 7-225082

[51] Int. Cl.[6] ..... H01P 1/20; H01P 5/12

[52] U.S. Cl. ..... 333/202; 333/134

[58] Field of Search ..... 333/202, 206, 333/208–212, 219, 219.1, 227, 230, 126, 134

[56] References Cited

U.S. PATENT DOCUMENTS

| | | | |
|---|---|---|---|
| 2,795,763 | 6/1957 | Tillotson | 333/208 |
| 4,249,148 | 2/1981 | Jachowski | 333/230 X |

FOREIGN PATENT DOCUMENTS

| | | | |
|---|---|---|---|
| 0552761 | 7/1993 | European Pat. Off. . | |
| 0661770 | 7/1995 | European Pat. Off. | 333/202 |
| 2557809 | 6/1977 | Germany . | |
| 54-0018260 | 2/1979 | Japan | 333/202 |
| 57-0148403 | 9/1982 | Japan | 333/134 |
| 61-0136301 | 6/1986 | Japan | 333/202 |
| 63-0299602 | 12/1988 | Japan | 333/219.1 |
| 5-48305 | 2/1993 | Japan | 333/202 |
| 5-67905 | 3/1993 | Japan | 333/219.1 |
| 2283370 | 5/1995 | United Kingdom . | |

OTHER PUBLICATIONS

Ishikawa et al., "800 MHz High Power Duplexer . . . Resonators", 1992 IEEE MTT–S Digest, pp. 1617–1620, Jan. 6, 1992.

B. Yu. Kapilevich et al: "A Compact Microwave Filter Based on a Three–Mode Cutoff Waveguide–Dielectric Cavity" Telecommunications and Radio Engineering, vol. 41/42, No. 9, Sep. 1987, pp. 97–100.

Patent Abstracts of Japan, vol. 3, No. 40 (E–102), 6 Apr. 1979 & JP 54 018260 A (Nippon Denki K.K.), 10 Feb. 1979, abstract.

Patent Abstracts of Japan, vol. 17, No. 344 (E–1390), 29 Jun. 1993 & JP 05 048305 A (Murata Mfg. Co Ltd), 26 Feb. 1993, abstract.

Patent Abstracts of Japan, vol. 96, No. 4, 30 Apr. 1996 & JP 07 336102 A (Murata Mfg. Co Ltd), 22 Dec. 1995, abstract, figures 11, 14.

European Search Report dated Jan. 26, 1998.

*Primary Examiner*—Seungsook Ham

*Attorney, Agent, or Firm*—Ostrolenk, Faber, Gerb & Soffen, LLP

[57] ABSTRACT

A dielectric filter utilizing a plurality of serially coupled resonators having attenuation maximums at the lower side or higher side, or both, of a pass band frequency region. The filter may include an input element which is coupled with both of a first resonator and a second resonator, and may also include an output element which is coupled with both the last and the next-to-last resonator. In the dielectric filter, it is not necessary to provide an external wire connection to generate such attenuation maximums.

32 Claims, 16 Drawing Sheets

DIELECTRIC FILTER

BACKGROUND OF THE INVENTION

1. Field of the Invention

The present invention relates to a dielectric filter, and more specifically relates to a dielectric filter utilizing TM multiple-mode dielectric resonators for use in an antenna duplexer for example.

2. Description of the Related Art

A TM multiple-mode dielectric resonator, which is configured with a dielectric rod complex disposed within an outer conductive member and made up of a plurality of intersected dielectric rods, has been used as a bandpass filter. By using a TM multiple-mode dielectric resonator, a compact and high order dielectric resonator can be easily realized. In designing a dielectric filter, to attenuate unnecessary signals at the lower-frequency side or the higher-frequency side of the transmission band, an attenuation maximum is provided at the lower-frequency side or the higher-frequency side of the transmission band.

The inventors have already submitted Japanese Patent Application No. 6-160271. In that application, the technology is applied to a dielectric filter using a TM multiple-mode dielectric resonator. FIG. 21 is a view showing a configuration of an embodiment according to the invention disclosed in that application. In FIG. 21, there are shown TM double-mode dielectric resonators 10*a* and 10*b*. Dielectric rods 1*a* and 1*b* are provided with coupling loops 11*a* and 11*b* magnetically coupled therewith, respectively, and coupling loops 12*a* and 12*b* magnetically coupled therewith, respectively. Between the two dielectric resonators, a partition plate 14 is disposed in order to magnetically couple dielectric rods 2*a* and 2*b* and to prevent coupling between dielectric rods 1*a* and 1*b*. The coupling loops 12*a* and 12*b* are connected with a cable 13.

FIG. 22 is an equivalent circuit diagram of the dielectric filter shown in FIG. 21. This filter is a bandpass filter made up of four resonators in which the first resonator and the last resonator are coupled.

FIG. 23 shows the characteristics of the filter. When the first resonator is not coupled with the last resonator, the filter has the bandpass characteristics shown by curve B. With the first and the last resonators coupled, attenuation maximums are generated at the lower-frequency side and the higher-frequency side of the transmission band as shown by curve A.

In a conventional dielectric filter in which two coupling loops are connected with a cable in order to couple the first resonator with the last resonator, the number of components increases and the size of the filter also increases to provide room for the connecting cable. The cost of assembly rises, and adjustment becomes complicated. Adjusting the frequency of one attenuation maximum is not possible, since the two attenuation maximums generated respectively at the lower-frequency and higher-frequency sides of the transmission band move together. In other words, it is relatively difficult to independently adjust the respective frequencies of the attenuation maximums.

SUMMARY OF THE INVENTION

Accordingly, it is an object of the present invention to provide a dielectric filter provided with the specified attenuation maximums without using a coupling loop or cable outside the filter.

Another object of the present invention is to provide a dielectric filter for which an attenuation maximum can be independently provided at a specified frequency on the lower-frequency side or the higher-frequency side of the transmission band.

The foregoing objects are achieved in one aspect of the present invention through the provision of a dielectric filter having bandpass filter characteristics and comprising a plurality of resonator stages using TM multiple-mode dielectric resonators, further comprising an external coupling element which is electromagnetically coupled with both of the first and the second-stage resonators so as to generate an attenuation maximum at the lower-frequency side or the higher-frequency side of the transmission band.

The foregoing objects are achieved in another aspect of the present invention through the provision of a dielectric filter having bandpass filter characteristics and comprising a plurality of resonator stages using TM multiple-mode dielectric resonators, further comprising an external coupling element which is electromagnetically coupled with both of the last and the next-to-the-last resonators so as to generate an attenuation maximum at the lower-frequency side or the higher-frequency side of the transmission band.

With these configurations, an attenuation maximum is generated at the lower-frequency side or the higher-frequency side of the transmission band. When the coupling between the first and the second-stage resonators and the coupling between the external coupling element and the first resonator are in phase, and the coupling between the external coupling element and the second-stage resonator is in phase, an attenuation maximum is generated at the higher-frequency side of the transmission band. When the coupling between the external coupling element and the second-stage resonator is in reverse phase with the other conditions being the same, an attenuation maximum is generated at the lower-frequency side of the transmission band. In the same way, when the coupling between the last and the next-to-the-last resonators and the coupling between the external coupling element and the last resonator are in phase, and the coupling between the external coupling element and the next-to-the-last resonator is in phase, an attenuation maximum is generated at the higher-frequency side of the transmission band. When the coupling between the external coupling element and the next-to-the-last resonator is in reverse phase with the other conditions being the same, an attenuation maximum is generated at the lower-frequency side of the transmission band.

The foregoing objects are achieved in still another aspect of the present invention through the provision of a dielectric filter having bandpass filter characteristics and comprising a plurality of resonator stages in which a plurality of TM multiple-mode dielectric resonators is coupled, further comprising a first external coupling element which is electromagnetically coupled with both of the first and the second-stage resonators and a second external coupling element which is electromagnetically coupled with both of the last and the next-to-the-last resonators so as to generate an attenuation maximum at the lower-frequency side and/or the higher-frequency side of the transmission band. An attenuation maximum is generated at each of the lower-frequency side and the higher-frequency side of the transmission band, or two attenuation maximums are both generated at one of the lower-frequency side or the higher-frequency side of the transmission band. When the coupling between the first and the second-stage resonators and the coupling between the first external coupling element and the first resonator are in phase, the coupling between the first external coupling element and the second-stage resonator is in phase, the coupling between the last and the next-to-the-last resonators and the coupling between the second external coupling element and the last resonator are in phase, and the coupling between the second external coupling element and the next-to-the-last resonator is in reverse phase, an attenuation maximum is generated at each of the lower-frequency side and the higher-frequency side of the transmission band. When the coupling between the first and the second-stage resonators and the coupling between the first external coupling element and the first resonator are in phase, the coupling between the first external coupling element and the second-stage resonator is in phase, the coupling between the last and the next-to-the-last resonators and the coupling between the second external coupling element and the last resonator are in phase, and the coupling between the second external coupling element and the next-to-the-last resonator is in phase, two attenuation maximums are generated at the higher-frequency side of the transmission band. When the coupling between the first and the second-stage resonators and the coupling between the first external coupling element and the first resonator are in phase, the coupling between the first external coupling element and the second-stage resonator is in reverse phase, the coupling between the last and the next-to-the-last resonators and the second external coupling element and the last resonator are in phase, and the coupling between the second external coupling element and the next-to-the-last resonator is in reverse phase, an attenuation maximum is generated at each of the lower-frequency side and the higher-frequency side of the transmission band. When the coupling between the first and the second-stage resonators and the coupling between the first external coupling element and the first resonator are in phase, the coupling between the first external coupling element and the second-stage resonator is in reverse phase, the coupling between the last and the next-to-the-last resonators and the coupling between the second external coupling element and the last resonator are in phase, and the coupling between the second external coupling element and the next-to-the-last resonator is in reverse phase, two attenuation maximums are generated at the lower-frequency side of the transmission band.

Since the above-described dielectric filters are provided with the specified attenuation maximums without requiring the use of a special coupling loop or cable, the number of components does not have to be increased to provide the pole. The size and cost are not increased, either.

The dielectric filters may be configured such that the TM multiple-mode dielectric resonators are provided with at least a dielectric rod disposed in a first direction and a dielectric rod disposed in a second direction which orthogonally intersects with the dielectric rod disposed in the first direction, and the external coupling element includes a portion which is electromagnetically coupled with the dielectric rod disposed in the first direction and a portion which is electromagnetically coupled with the dielectric rod disposed in the second direction.

The dielectric filters may be configured such that the TM multiple-mode dielectric resonators are provided with at least a dielectric rod disposed in a first direction and a dielectric rod disposed in a second direction which orthogonally intersects with the dielectric rod disposed in the first direction, and the external coupling element is configured by a coupling loop disposed in a direction such that the coupling loop is electromagnetically coupled with both of the dielectric rod disposed in the first direction and the dielectric rod disposed in the second direction. With these configurations, a single external coupling element is used to generate an attenuation maximum because the external coupling element is electromagnetically coupled with the first and the second-stage resonators or coupled with the last and the next-to-the-last resonators.

Since the above-described dielectric filters are provided with an attenuation maximum by the use of a single external coupling element, the specified attenuation maximum can be generated with fewer components used, and the assembly and adjustment of the filters are facilitated.

Other features and advantages of the present invention will become apparent from the following description of embodiments of the invention which refers to the accompanying drawings.

DETAILED DESCRIPTION OF PREFERRED EMBODIMENTS

A configuration of a dielectric filter according to a first embodiment of the present invention will be described below by referring to FIGS. 1 to 4.

Figure 1:
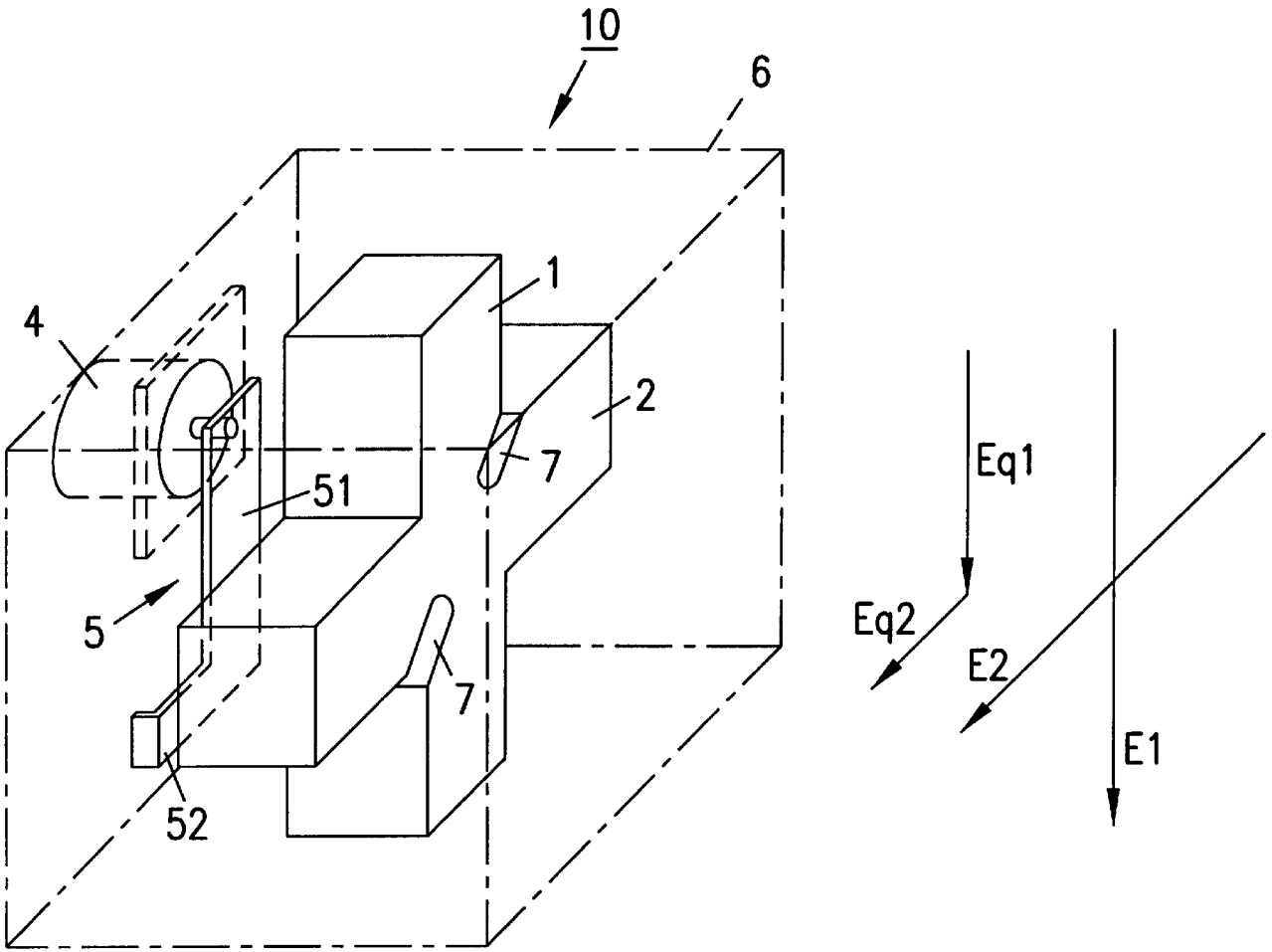
FIG. 1 is a perspective view of a main section of a dielectric filter according to a first embodiment of the present invention.

In FIG. 1, dielectric rods 1 and 2 are disposed orthogonally to each other and grooves 7 are provided at the intersection. A dielectric rod complex made up of such a plurality of dielectric rods combined is disposed in an outer conductive member 6 to form a dielectric resonator 10. In FIG. 1, there is also shown an external coupling element 5.

Figure 2A:
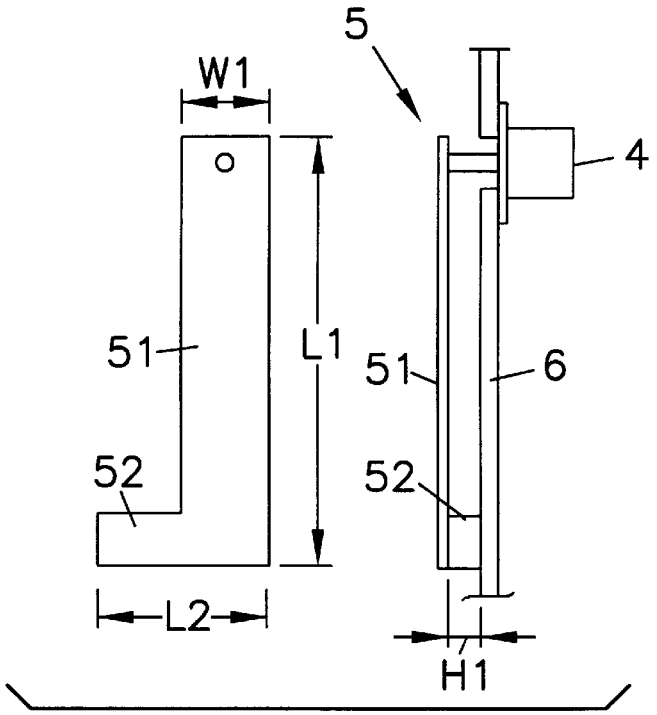
FIG. 2A and 2B show a configuration of an external coupling element according to the first embodiment.

FIG. 2A shows an elevation and a right-hand side view of the external coupling element shown in FIG. 1, which includes a first coupling portion 51 and a second coupling portion 52. The first coupling portion 51 is connected to the central conductor of a signal input/output connector 4 at one end and the second coupling portion 52 is connected to the inner surface (ground) of the outer conductive member 6 at one end. The first coupling portion 51 and the second coupling portion 52 are continuous. The central conductor of the input/output connector 4, the external coupling element 5, and the outer conductive member 6 form a loop.

Since the first coupling portion 51 is disposed in parallel with the axial direction of the dielectric rod 1 and the second coupling portion 52 is disposed in parallel with the axial direction of the dielectric rod 2, the first coupling portion 51 and the dielectric rod 1 are magnetically coupled and the second coupling portion 52 and the dielectric rod 2 are magnetically coupled. The resonator made up of the dielectric rod 2 is also coupled with the resonator made up of the dielectric rod 1 since the grooves 7 are formed at the intersection of the dielectric rod 1 and the dielectric rod 2.

The resonator made up of the dielectric rod 1 may be considered the first resonator in a multistage filter and the resonator made up of the dielectric rod 2 may be considered the second-stage resonator. On the other hand, the resonator made up of the dielectric rod 1 may also be the last resonator and in that case, the resonator made up of the dielectric rod 2 may be the resonator disposed one stage before. The conditions are the same in both cases.

FIG. 1 also shows instantaneous electric-field vectors at the same time generated in the external coupling element and the dielectric rods. When the electric-field vectors E1 and E2 generated in the dielectric rods 1 and 2 are in phase, the electric-field vectors Eq1 and Eq2 corresponding to the first coupling portion 51 and the second coupling portion 52 of the external coupling element 5 appear as shown in the figure and the sections are coupled with the corresponding dielectric rods in phase, respectively.

Figure 2B:
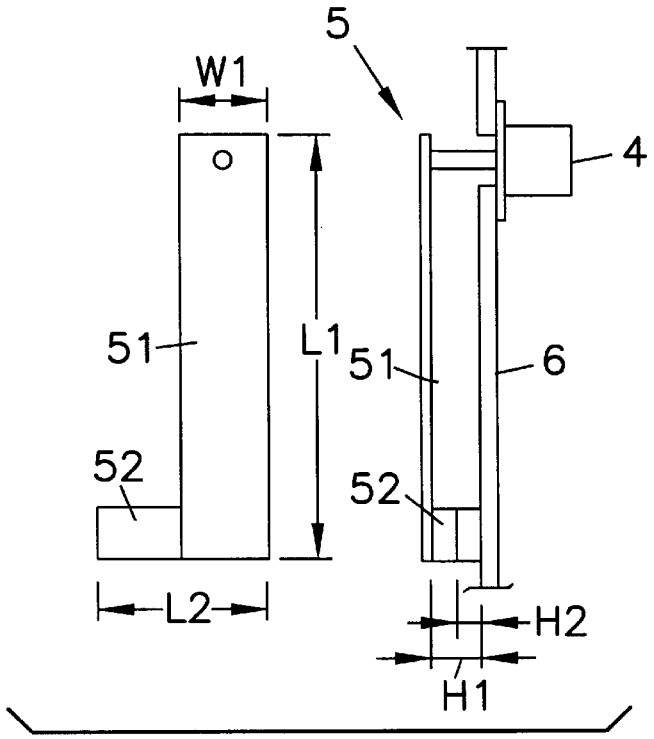

FIG. 2B shows an elevation and a right-hand side view of another similar external coupling element, in which a step is formed between the portions 51 and 52.

In FIGS. 2A and 2B, the outer conductive member or casing 6 is made from a metallic panel and the input/output connector 4 is mounted on the casing 6. One end of the external coupling element 5 is soldered to the central conductor of the input/output connector 4 and the other end is soldered to the inner surface of the outer conductive member 6.

In the external coupling element shown in FIG. 2A, as the length L1 and the width W1 of the first coupling portion 51 and the height H1 from the outer conductive member 6 become larger, the coupling level with the resonator made up of the dielectric rod 1 shown in FIG. 1 increases. As the length L2 of the second coupling portion 52 and the height H1 from the outer conductive member 6 become larger, the coupling level with the resonator made up of the dielectric rod 2 shown in FIG. 1 increases. In this way, the coupling level between the external coupling element and the first (or the last) resonator and the coupling level between the external coupling element and the second (or the stage immediately before the last stage) resonator can be set independently.

In the external coupling element shown in FIG. 2B, by forming a step between the portions 51 and 52, the height H2 of the second coupling portion 52 is set lower than the height H1 of the first coupling portion 51, so that the coupling level between the second coupling portion 52 and the resonator made up of the dielectric rod 2 shown in FIG. 1 is set relatively low. In this way, the coupling level between the external coupling element and the first (or the last) resonator and the coupling level between the external coupling element and the second-stage (or the stage immediately before the last stage) resonator can be set independently, simply by changing H1 and/or H2 respectively.

Figure 3:
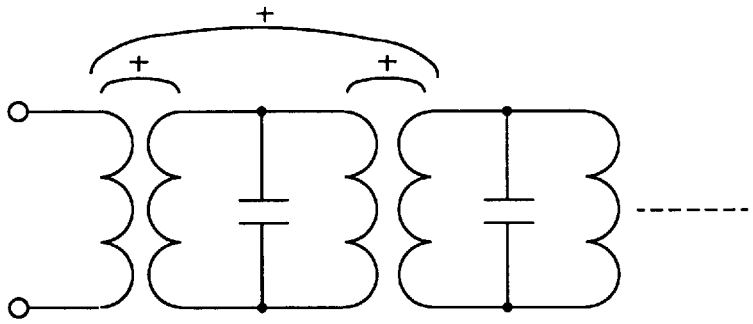
FIG. 3 is an equivalent circuit diagram of the dielectric filter according to the first embodiment.
Figure 4:
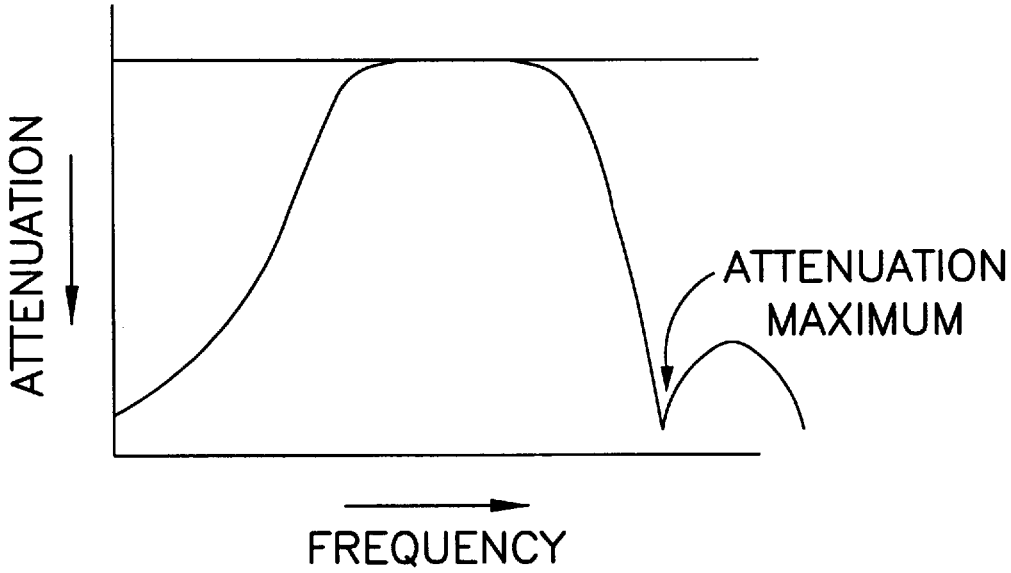
Fig. 4 shows the characteristics of the dielectric filter according to the first embodiment.

FIG. 3 is an equivalent circuit diagram of the dielectric filter shown in FIG. 1. When the coupling between the input/output coupling inductor generated by the external coupling element and the first (or the last) resonator is in phase with the coupling between the first (or the last) resonator and the second-stage (or the stage immediately before the last stage) resonator, the coupling between the input/output inductor and the second-stage (or the stage immediately before the last stage) resonator is also in phase due to the external coupling element configured as described above. With this configuration, an attenuation maximum is generated at the higher-frequency side of the transmission band as shown in FIG. 4.

FIG. 1 shows a single TM double-mode dielectric resonator. By arranging TM double-mode dielectric resonators having the same configuration and sequentially coupling specified resonators, a third-order or higher-order dielectric filter having three or more resonators can be configured. Or, a dielectric filter including two resonators can be configured by providing, in addition to the input/output connector 4 and the external coupling element 5, another external coupling element which couples with another input/output connector and with the resonator made up of the dielectric rod 2 in the configuration shown in FIG. 1.

A configuration of a dielectric filter according to a second embodiment of the present invention will be described below by referring to FIGS. 5 to 7.

Figure 5:
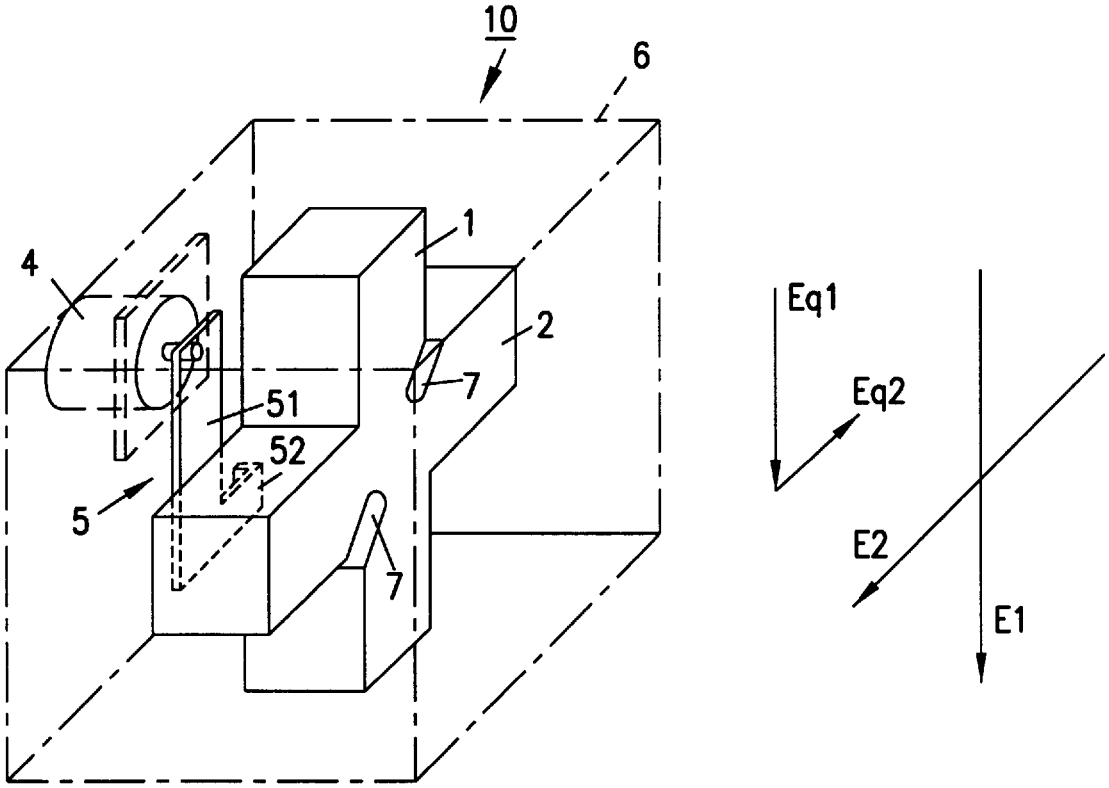
FIG. 5 is a perspective view of a main section of a dielectric filter according to a second embodiment of the present invention.

In FIG. 5, dielectric rods 1 and 2 are disposed orthogonally to each other and grooves 7 are provided at the intersection, forming a dielectric rod complex, which is disposed in an outer conductive member 6. In FIG. 5, there is also shown an external coupling element 5 which includes a first coupling portion 51 and a second coupling portion 52. The first coupling portion 51 is connected to the central conductor of a signal input/output connector 4 at one end and the second coupling portion 52 is connected to the inner surface (ground) of the outer conductive member 6 at one end. The first coupling portion 51 and the second coupling portion 52 are continuous. The central conductor of the input/output connector 4, the external coupling element 5, and the outer conductive member 6 form a loop. Since the first coupling portion 51 is disposed in parallel with the axial direction of the dielectric rod 1 and the second coupling portion 52 is disposed in parallel with the axial direction of the dielectric rod 2, the first coupling portion 51 and the dielectric rod 1 are magnetically coupled and the second coupling portion 52 and the dielectric rod 2 are magnetically coupled. The resonator made up of the dielectric rod 2 is coupled with the resonator made up of the dielectric rod 1 since the grooves 7 are formed at the intersection of the dielectric rod 1 and the dielectric rod 2. The resonator made up of the dielectric rod 1 will be considered to be the first resonator and the resonator made up of the dielectric rod 2 will be considered the second-stage resonator. FIG. 5 shows instantaneous electric-field vectors at the same time generated in the external coupling element and the dielectric rods. When the electric-field vectors E1 and E2 generated in the dielectric rods 1 and 2 are in phase, the electric-field vectors Eq1 and Eq2 corresponding to the first coupling portion 51 and the second coupling portion 52 of the external coupling element 5 appear as shown in the figure. The dielectric rod 1 is coupled with the first coupling portion 51 in phase and the dielectric rod 2 is coupled with the second coupling portion 52 in reverse phase.

Figure 6:
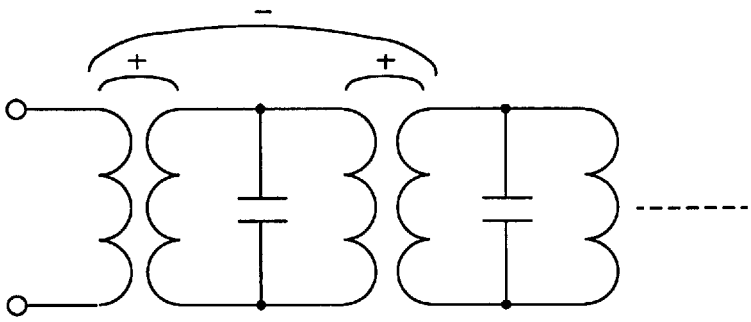
FIG. 6 is and equivalent circuit diagram of the dielectric filter according to the second embodiment.
Figure 7:
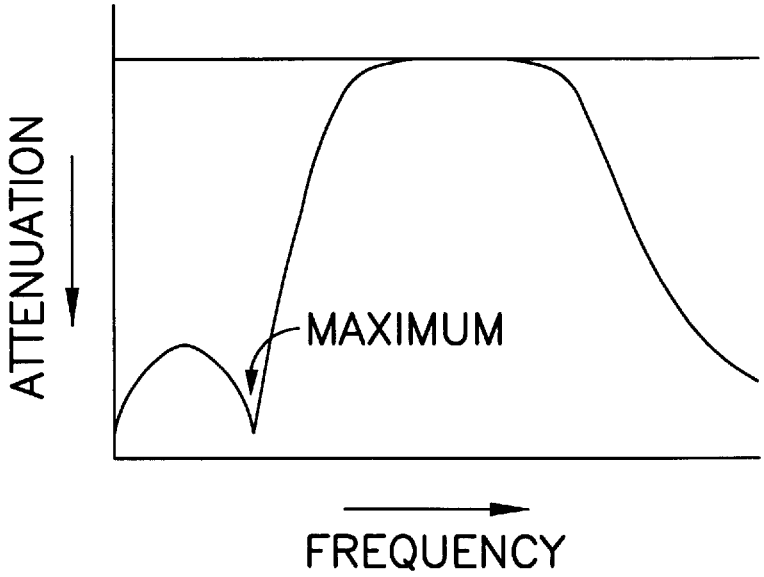
FIG. 7 shows the characteristics of the dielectric filter according to the second embodiment.
Figure 23:
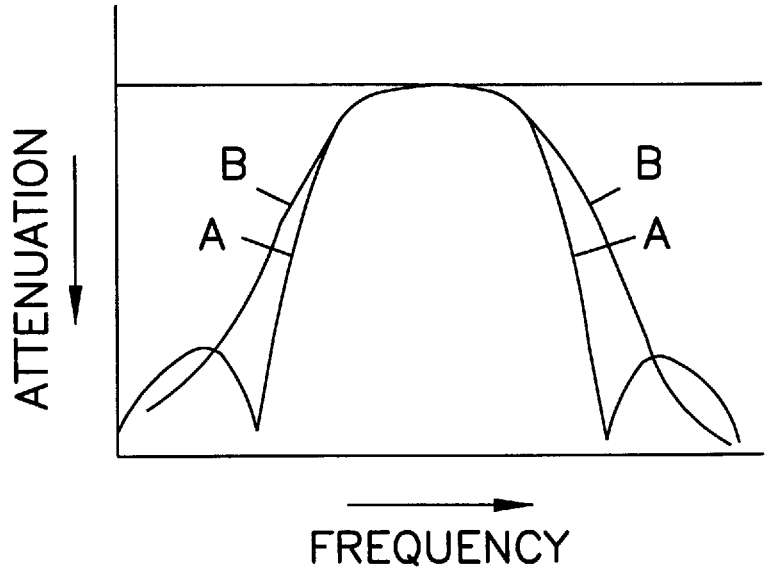
FIG. 23 PRIOR ART
FIG. 23 shows the characteristics of the dielectric filter shown in FIG. 21.

FIG. 6 is an equivalent circuit diagram of the dielectric filter shown in FIG. 5. When the coupling between the input/output coupling inductor generated by the external coupling element and the first resonator is in phase with the coupling between the first resonator and the next-stage resonator, the coupling between the input/output inductor and the next-stage (the second-stage) resonator is in reverse phase due to the external coupling element configured as described above. With this configuration, an attenuation maximum is generated at the lower-frequency side of the transmission band as shown in FIG. 7.

Figure 8A:
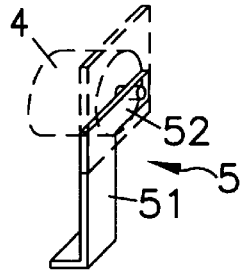
FIG. 8A to 8I are perspective views showing respective configurations of external coupling elements for use in a dielectric filter according to a third embodiment.
Figure 8B:
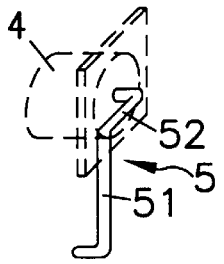
Figure 8C:
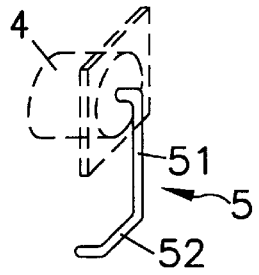

In FIG. 8A, a second coupling portion 52 is provided near the central conductor of the input/output connector 4 and a first coupling portion 51 is connected to the inner surface of the outer conductor at one end. When this external coupling element 5 is substituted for the external coupling element shown in FIG. 1, the same characteristics as those of the dielectric filter shown in the first embodiment are obtained. In FIG. 8B, instead of using a metallic plate, a rod- or wire-shaped metallic member is bent to form a first coupling portion 51 and a second coupling portion 52. In FIG. 8C, a rod- or wire-shaped metallic member is used in the same way. One end of a first coupling portion 51 is connected to the central conductor of the input/output connector 4, and one end of a second coupling portion 52 is connected to the inner surface of the outer conductor.

Figure 8D:
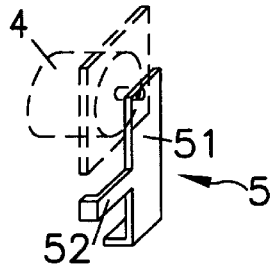
Figure 8E:
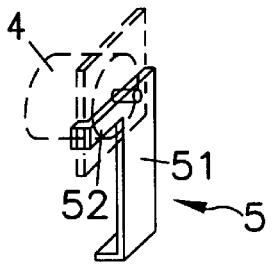

In FIGS. 8D and 8E, a first coupling portion 51 is connected to the central conductor of the input/output connector 4 at one end, and is connected to the inner surface of the outer conductor at the other end. In addition, a second coupling portion 52 protrudes from the first coupling portion 51 toward a side and is connected to the inner surface of the outer conductor at one end.

Figure 8F:
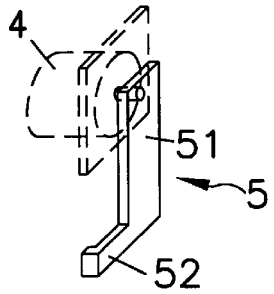

In FIG. 8F, one end of a first coupling portion 51 is connected to the central conductor of the input/output connector 4, and a second coupling portion 52 protruding from the other end of the first coupling portion 51 toward a side is connected to the inner surface of the outer conductor at one end. When such an external coupling element is used in the configuration shown in FIG. 1, the first coupling portion 51 is coupled with the resonator made up of the dielectric rod 1, and the second coupling portion 52 is coupled with the resonator made up of the dielectric rod 2.

Figure 8G:
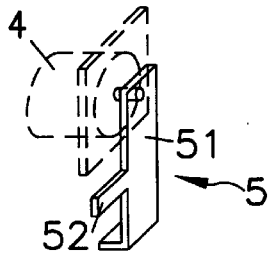
Figure 8H:
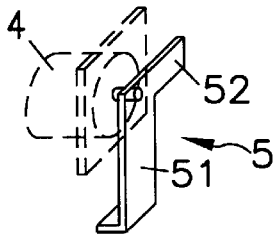
Figure 8I:
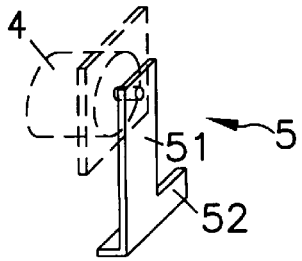

In FIGS. 8G, 8H, and 8I, one end of a first coupling portion 51 is connected to the central conductor of the input/output connector 4 and the other end is connected to the inner surface of the outer conductor. Toward a side of the first coupling portion 51, a second coupling portion 52 protrudes, and one end of the second coupling portion 52 is left open.

Figure 9A:
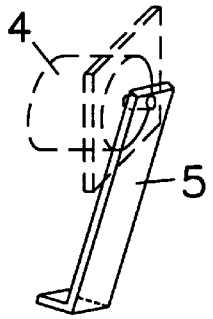
FIG. 9A is a perspective view.
Figure 9B:
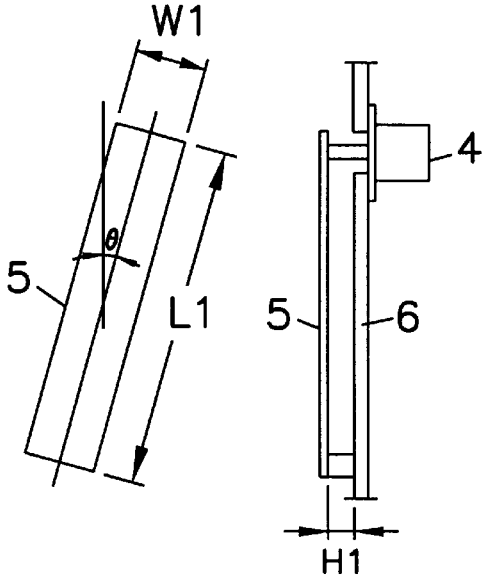
Fig. 9B is an elevation, and a side showing a configuration of an external coupling element for use in a dielectric filter according to a fourth embodiment.

FIG. 9A is a perspective view, FIG. 9B is an elevation, and a right-hand side view showing a fourth embodiment of the invention. In this embodiment, the external coupling element 5 does not have a distinct first coupling portion and second coupling portion, as described above. Rather, the whole loop formed by the external coupling element and the outer conductor is slanted. When this external coupling element is substituted for the external coupling element shown in FIG. 1, the device is coupled with both the resonator made up of the dielectric rod 1 and the resonator made up of the dielectric rod 2. The coupling levels between the external coupling element 5 and the two resonators change according to the slant angle θ shown in FIG. 9B of the external coupling element 5. In other words, when angle θ decreases, the coupling level between the external coupling element and the first resonator (dielectric rod 1) increases and the coupling level between the external coupling element and the next-stage resonator (dielectric rod 2) decreases. In contrast, when angle θ increases, up to 90 degrees, the coupling level between the external coupling element and the first resonator decreases and the coupling level between the external coupling element and the next-stage resonator increases. As the length L1, the width W1, and the height H1 of the external coupling element become larger, the coupling level between the external coupling element and the first resonator and the coupling level between the external coupling element and the next-stage resonator become larger. In this configuration, the coupling level between the external coupling element and the first resonator and the coupling level between the external coupling element and the next-stage resonator cannot be independently specified. By taking these relationships into consideration, the dimensions of each section and the mounting angle need to be specified.

Figure 10:
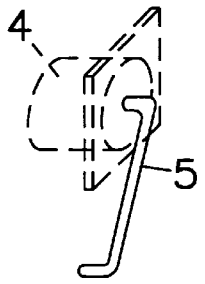
FIG. 10 is a perspective view showing a configuration of an external coupling element for use in a dielectric filter according to a fifth embodiment.

FIG. 10 shows a configuration of an external coupling element used for a dielectric filter according to a fifth embodiment of the present invention. A rod- or wire-shaped metallic member is used to form an external coupling element, instead of a metallic plate. The other configurations are the same as those used in FIG. 9A. Therefore, also in this case, by specifying the slant angle θ, the length L1, and the height H1 of the external coupling element 5, the coupling level between the external coupling element and the first (or the last) resonator and the coupling level between the external coupling element and the next-stage (or the stage immediately before the last) resonator are specified.

A configuration of a dielectric filter according to a sixth embodiment of the present invention will be described below by referring to FIGS. 11 and 12.

Figure 11:
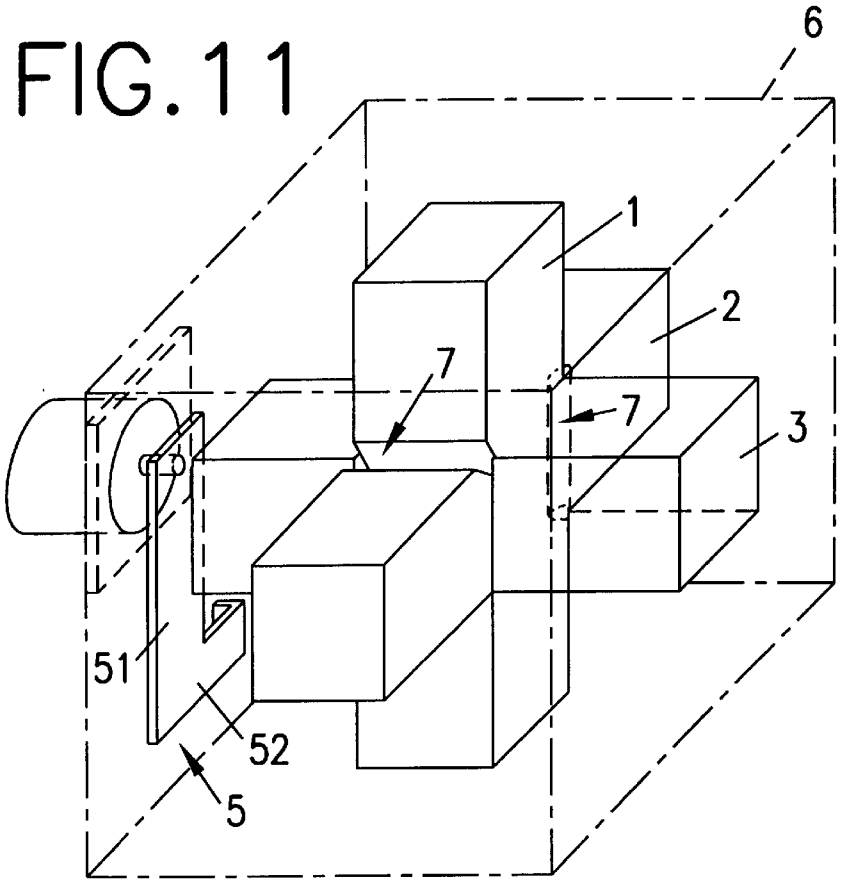
FIG. 11 is a perspective view of a main section of a dielectric filter according to a sixth embodiment of the present invention.

FIG. 11 is a perspective view showing the configuration of the main section of a dielectric filter. In the figure, there are shown dielectric rods 1, 2, and 3 disposed orthogonally to each other and grooves 7 provided at the intersections. A dielectric rod complex made up of such a plurality of dielectric rods is disposed in an outer conductive member 6. In FIG. 11, there is also shown an external coupling element 5 which includes a first coupling portion 51 and a second coupling portion 52. The first coupling portion 51 is connected to the central conductor of a signal input/output connector 4 at one end and the second coupling portion 52 is connected to the inner surface (ground) of the outer conductive member 6 at one end. The first coupling portion 51 and the second coupling portion 52 are continuous. The central conductor of the input/output connector 4, the external coupling element 5, and the outer conductive member 6 form a loop. Since the first coupling portion 51 is disposed in parallel with the axial direction of the dielectric rod 1 and the second coupling portion 52 is disposed in parallel with the axial direction of the dielectric rod 2, the first coupling portion 51 and the dielectric rod 1 are magnetically coupled and the second coupling portion 52 and the dielectric rod 2 are magnetically coupled. The resonator made up of the dielectric rod 3 is not coupled with the first coupling portion 51 or the second coupling portion 52. The resonator made up of the dielectric rod 2 is coupled with the resonator made up of the dielectric rod 1 since the grooves 7 are formed at the intersection of the dielectric rod 1 and the dielectric rod 2. Since the grooves 7 are also formed at the intersection of the dielectric rod 2 and the dielectric rod 3, the resonator made up of the dielectric rod 3 is coupled with the resonator made up of the dielectric rod 2. Therefore, the resonator made up of the dielectric rod 1 serves as the first resonator, the resonator made up of the dielectric rod 2 serves as the second-stage resonator, and the resonator made up of the dielectric rod 3 serves as the third-stage resonator.

FIG. 11 shows instantaneous electric-field vectors at the same time generated in the external coupling element and the dielectric rods. When the electric-field vectors E1 and E2 generated in the dielectric rods 1 and 2 are in phase, the electric-field vectors Eq1 and Eq2 corresponding to the first coupling portion 51 and the second coupling portion 52 of the external coupling element 5 appear as shown in the figure and the sections are coupled with the dielectric rods 1 and 2 in phase.

Figure 12:
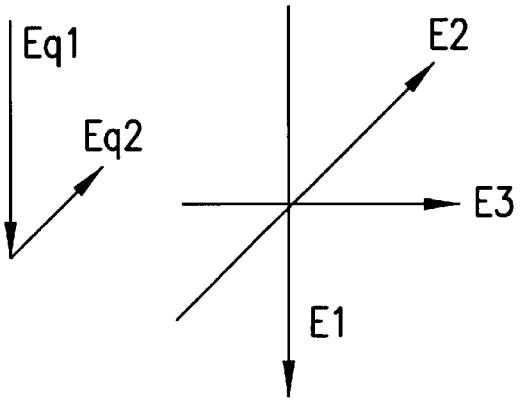
FIG. 12 is an equivalent circuit diagram of the dielectric filter according to the sixth embodiment.
Figure 12:
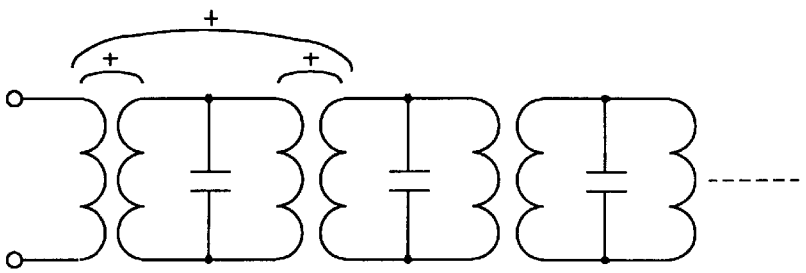

FIG. 12 is an equivalent circuit diagram of the dielectric filter shown in FIG. 11. When the coupling between the input/output coupling inductor generated by the external coupling element and the first resonator is in phase with the coupling between the first resonator and the next-stage resonator, the coupling between the input/output inductor and the next-stage (the second-stage) resonator is also in phase due to the external coupling element configured as described above. With this configuration, an attenuation maximum is generated at the higher-frequency side of the transmission band as shown in FIG. 4.

A configuration of an antenna duplexer according to a seventh embodiment of the present invention will be described below by referring to FIGS. 13 to 19.

Figure 13:
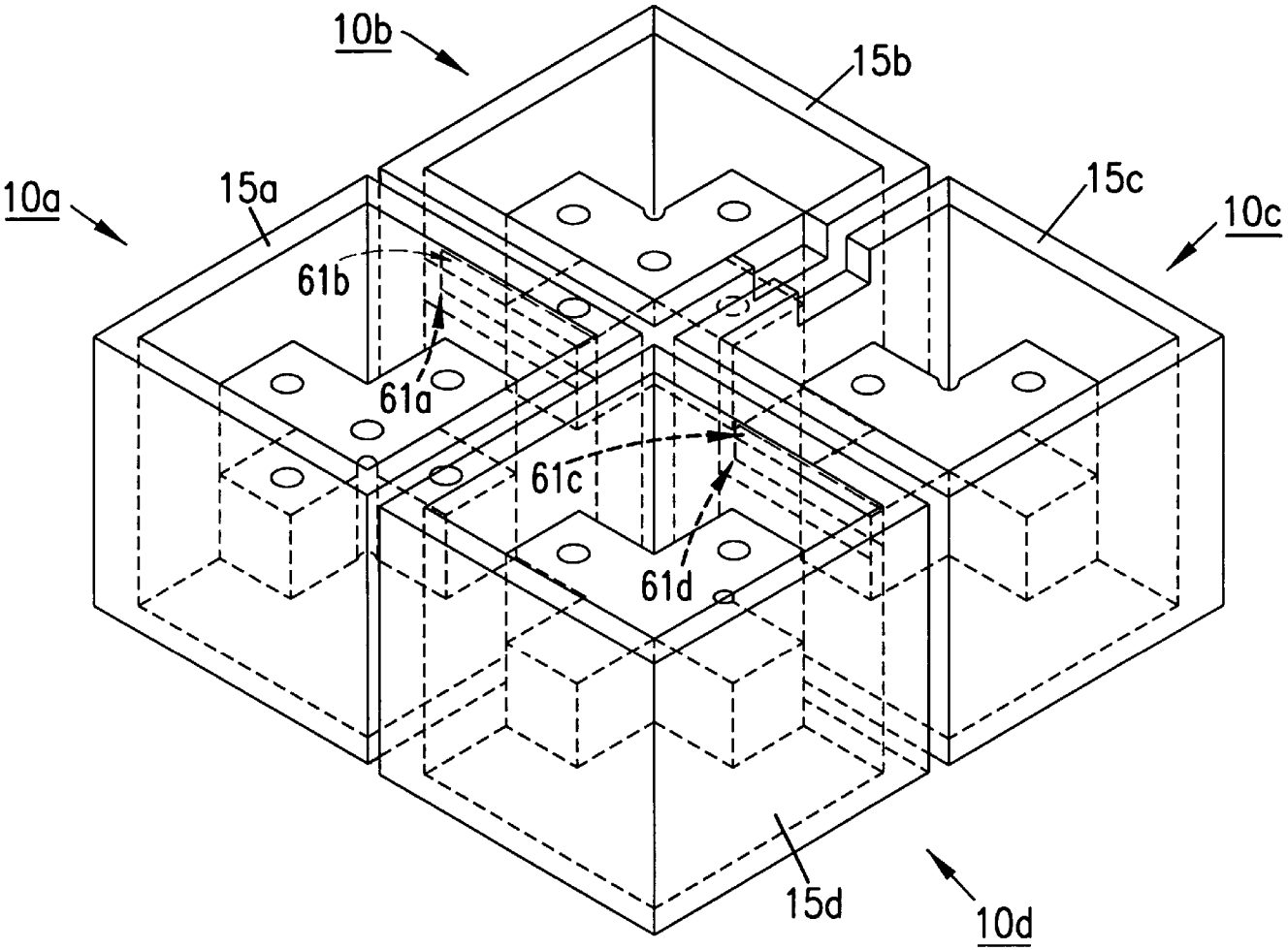
FIG. 13 is a perspective view showing the arrangement of dielectric resonators in an antenna duplexer according to a seventh embodiment.

FIG. 13 is a perspective view showing components of an antenna duplexer, other components not being shown in this view. In FIG. 13, there are shown casings 15*a*, 15*b*, 15*c*, and 15*d* which are connected to form a unit with cross-shaped dielectric rod complexes disposed inside and which have outer conductors formed at the outer surfaces. Coupling windows 61*a* and 61*b* are formed at surfaces opposing each other of the cavities 15*a* and 15*b*. In the same way, coupling windows 61*c* and 61*d* are formed at surfaces opposing each other of the cavities 15*c* and 15*d*. Four TM double-mode dielectric resonators 10*a*, 10*b*, 10*c*, and 10*d* are arranged in this way. As will be described later, metallic panels to which external coupling elements are mounted are placed at the upper and lower surfaces of the cavities 15*a*, 15*b*, 15*c*, and 15*d* and are soldered through grounding plates.

Figure 14:
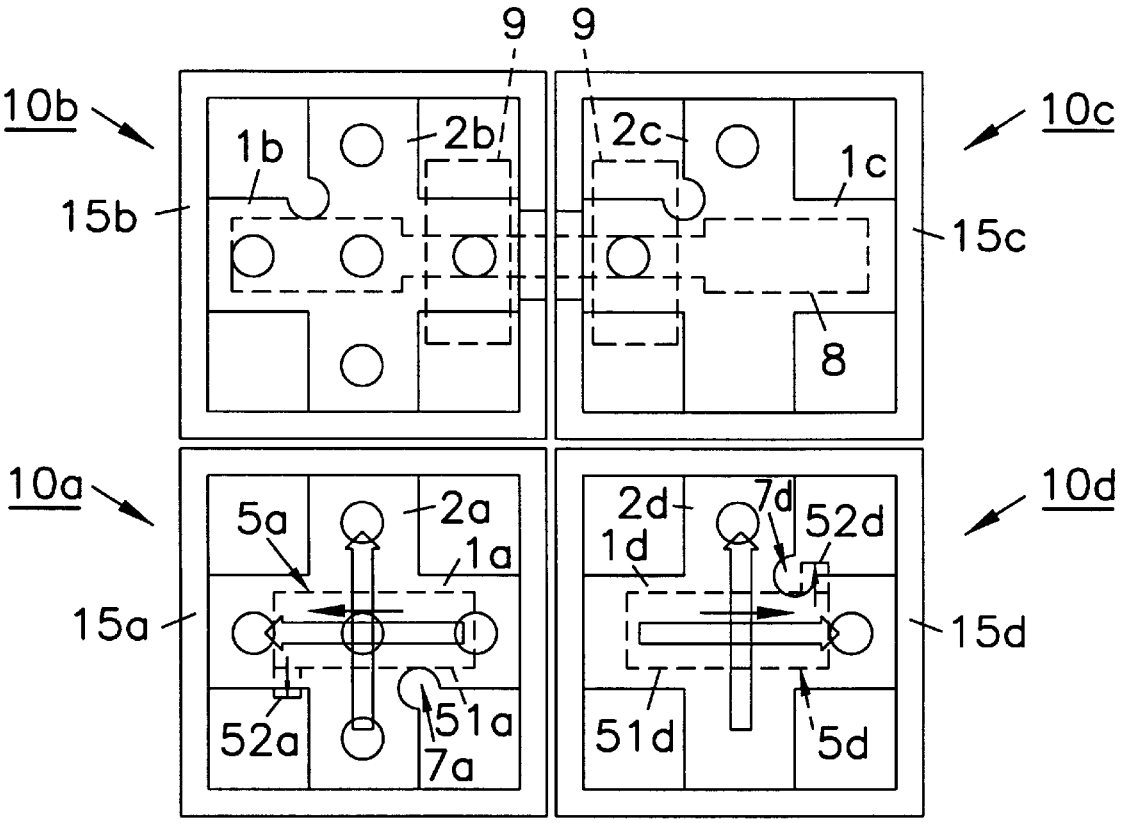
FIG. 14 is a top view of the antenna duplexer shown in FIG. 13.

FIG. 14 is a plan view showing the components illustrated in FIG. 13. The relationship between dielectric rods and external coupling elements, which are shown in phantom in the figure. External coupling elements 5*a* and 5*d* and a coupling device 8 for connection to the antenna are mounted to the upper metallic panel.

Figure 15A:
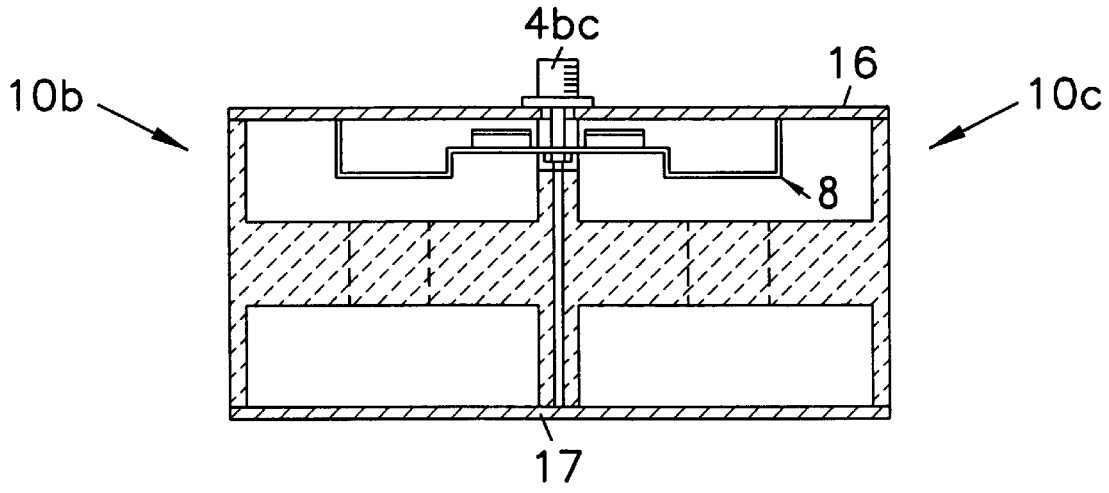
FIG. 15A and 15B are cross sections of the main section of the antenna duplexer according to the seventh embodiment.
Figure 15B:
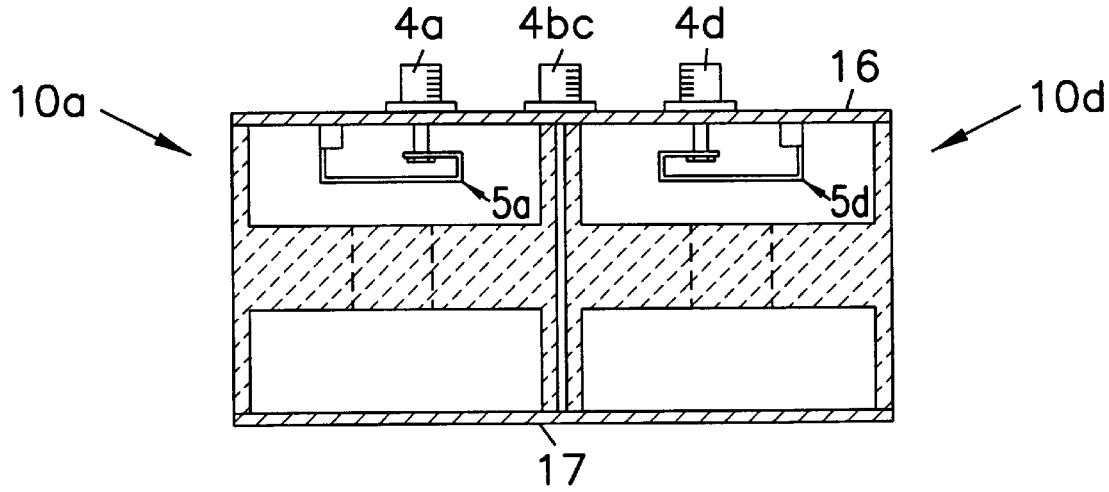

FIG. 15A and 15B are cross sections of an assembled antenna duplexer. FIG. 15A is a cross section taken on a line passing through the coupling device 8 for connection to the antenna, and FIG. 15B is a cross section taken on a line passing through the external coupling elements 5*a*, 5*d*. In FIGS. 15A and 15B, there is shown an upper metallic panel 16 and a lower metallic panel 17. An input/output connector 4bc serving as an antenna terminal, an input/output connector 4*a* serving as a TX-IN terminal, and an input/output connector 4*d* serving as an RX-OUT terminal are mounted to the upper metallic panel 16. At the inner surface of the upper metallic panel 16, the coupling device 8 at the antenna side and the external coupling elements 5*a* and 5*d* are mounted.

Figure 16A:
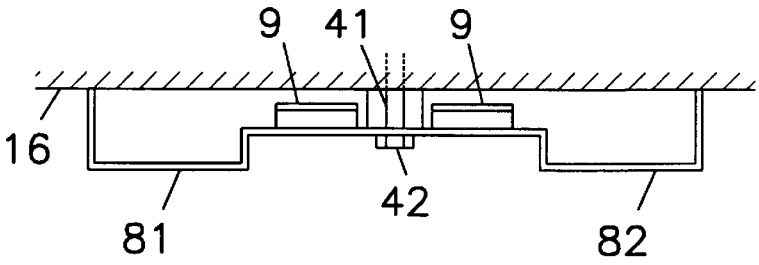
Fig. 16A and 16B show a configuration of a coupling device for connection to the antenna.
Figure 16B:
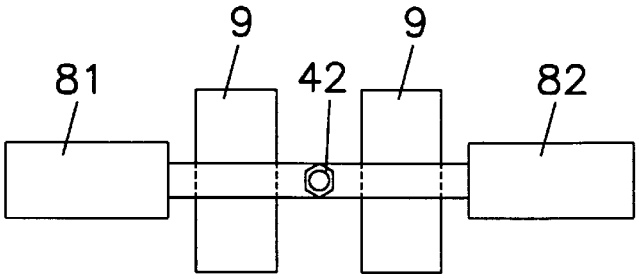

FIG. 16A is a plan view and FIG. 16B is a bottom view showing a configuration of the coupling device 8. Coupling loops 81 and 82 form loops together with the central conductor 41 of the input/output connector and the upper metallic panel 16. The tip of the central conductor 41 of the input/output connector is threaded and the coupling loops 81 and 82 are secured to the tip with a nut 42. As clearly understood from FIGS. 14 to 16B, the coupling loop 81 is magnetically coupled with the dielectric rod 1*b* of the dielectric resonator 10*b*, and the coupling loop 82 is magnetically coupled with the dielectric rod 1*c* of the dielectric resonator 10*c*. As shown in FIG. 16B, phase-adjustment electrodes 9 generate the specified capacitance with the upper metallic panel 16 to adjust the phases of the signals induced by the coupling loops 81 and 82.

Figure 17B:
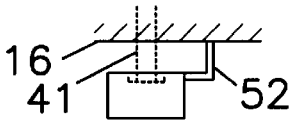
FIG. 17A, 17B and 17C show the configuration of an external coupling element.
Figure 17A:
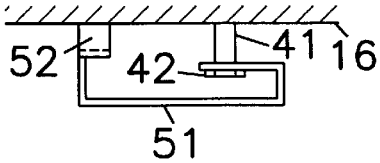
Figure 17C:
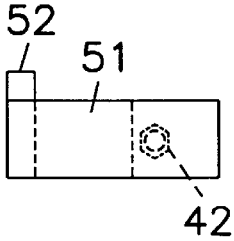

FIG. 17A is an elevation, FIG. 17B is a left-hand side view, and FIG. 17C is a bottom view showing a configuration of the external coupling elements 5*a* and 5*d* shown in FIGS. 15A and 15B. Since the devices have substantially the same shapes, only one of them is shown in FIGS. 17A–17C. As shown, an external coupling element mainly includes a first coupling portion 51 and a second coupling portion 52. One end of the first coupling portion 51 is connected and secured with a nut 42 to the central conductor of the input/output connector protruding from the upper metallic panel 16, and one end of the second coupling portion 52 is soldered to the upper metallic panel 16. By providing two of such external coupling elements 5*a* and 5*d*, the dielectric rod 1*a* of the dielectric resonator 10*a* and the first coupling portion 51*a* are magnetically coupled, and the dielectric rod 2*a* and the second coupling portion 52*a* are magnetically coupled, all of these elements being shown in FIG. 14. In addition, the dielectric rod 1*d* of the dielectric resonator 10*d* and the first coupling portion 51*d* are magnetically coupled, and the dielectric rod 2*d* and the second coupling portion 52*d* are magnetically coupled. As shown in FIG. 14, since a groove 7*a* is formed at the intersection of the dielectric rods 1*a* and 2*a* in the dielectric resonator 10*a*, when the instantaneous electric-field vectors in phase generated by the two resonators made up of the dielectric rods 1*a* and 2*a* are shown by hollow arrows in FIG. 14, the coupling between the first coupling portion 51*a* and the dielectric rod 1*a* is in phase and the coupling between the second coupling portion 52*a* and the dielectric rod 2*a* is in reverse phase as shown by the solid arrows. Since a groove 7*d* is formed at the intersection of the dielectric rods 1*d* and 2*d* in the dielectric resonator 10*d*, when the instantaneous electric-field vectors in phase generated by the two resonators made up of the dielectric rods 1*d* and 2*d* are shown by hollow arrows in FIG. 14, the coupling between the first coupling portion 51*d* and the dielectric rod 1*d* is in phase and the coupling between the second coupling portion 52*d* and the dielectric rod 2*d* is in reverse phase as shown by the solid arrows.

Figure 18:
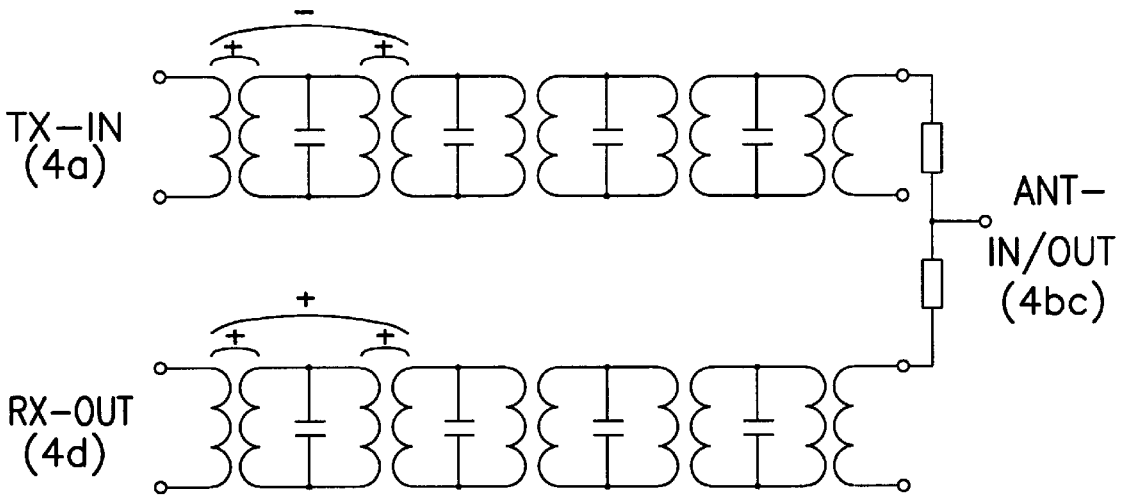
FIG. 18 is an equivalent circuit diagram of the antenna duplexer according to the seventh embodiment.
Figure 19B:
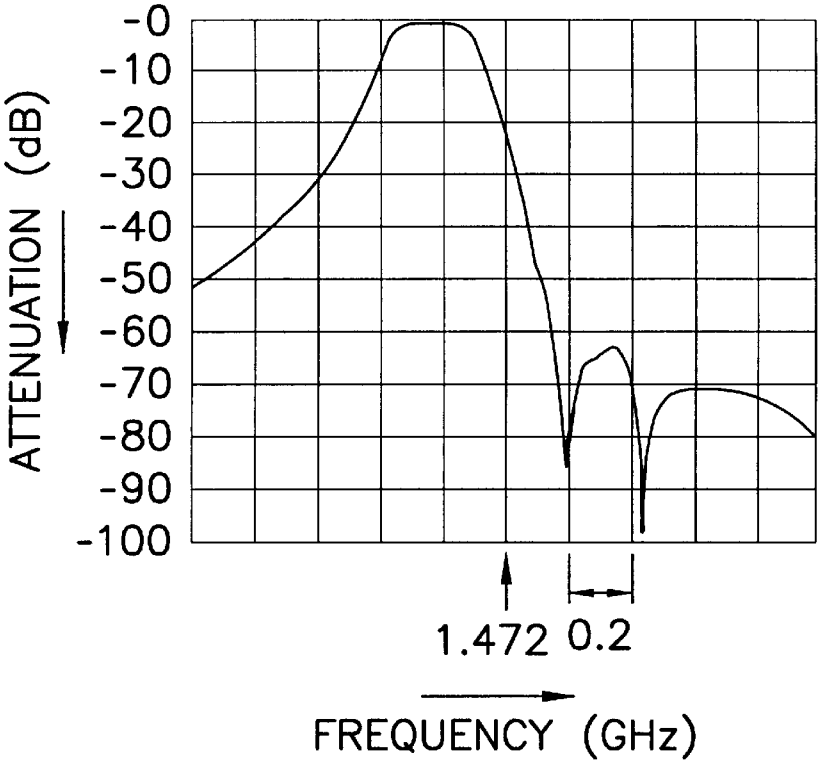
FIG. 19A and 19B shows the characteristics of the antenna duplexer according to the seventh embodiment.
Figure 19A:
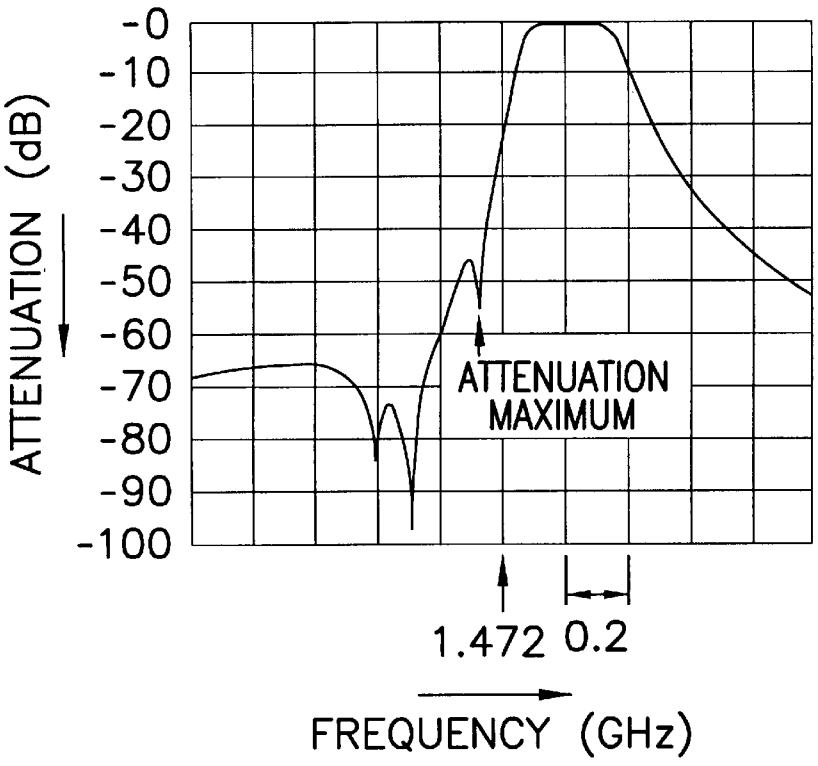

FIG. 18 is an equivalent circuit diagram of the antenna duplexer. FIG. 19 shows the characteristics of a transmission filter and a receiving filter. As shown in FIG. 18, since the coupling between the TX-IN input/output coupling inductor and the second-stage resonator is in reverse phase, an attenuation maximum is generated at the lower-frequency side of the transmission band as shown in FIG. 19A. With this attenuation maximum, signal components in the receiving band are more steeply cut. Since the coupling between the RX-OUT input/output coupling inductor and the resonator at the stage immediately before the last stage is in phase, an attenuation maximum is generated at the higher-frequency side of the transmission band as shown in FIG. 19B. With this attenuation maximum, transmission-signal components are steeply cut.

Figure 20A:
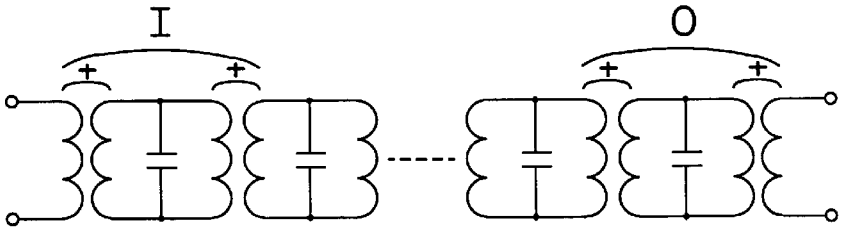
FIG. 20A to 20E show the equivalent circuit diagram and the characteristics of a dielectric filter according to an eighth embodiment.
Figure 20B:
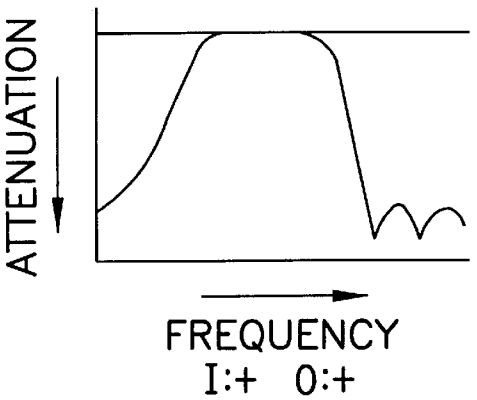
Figure 20C:
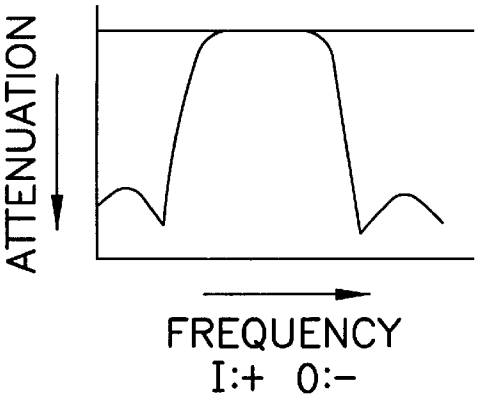
Figure 20D:
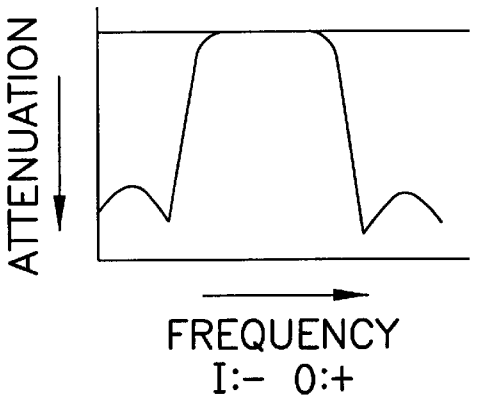
Figure 20E:
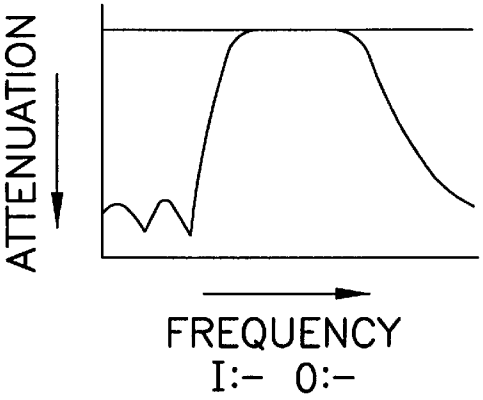
Figure 21:
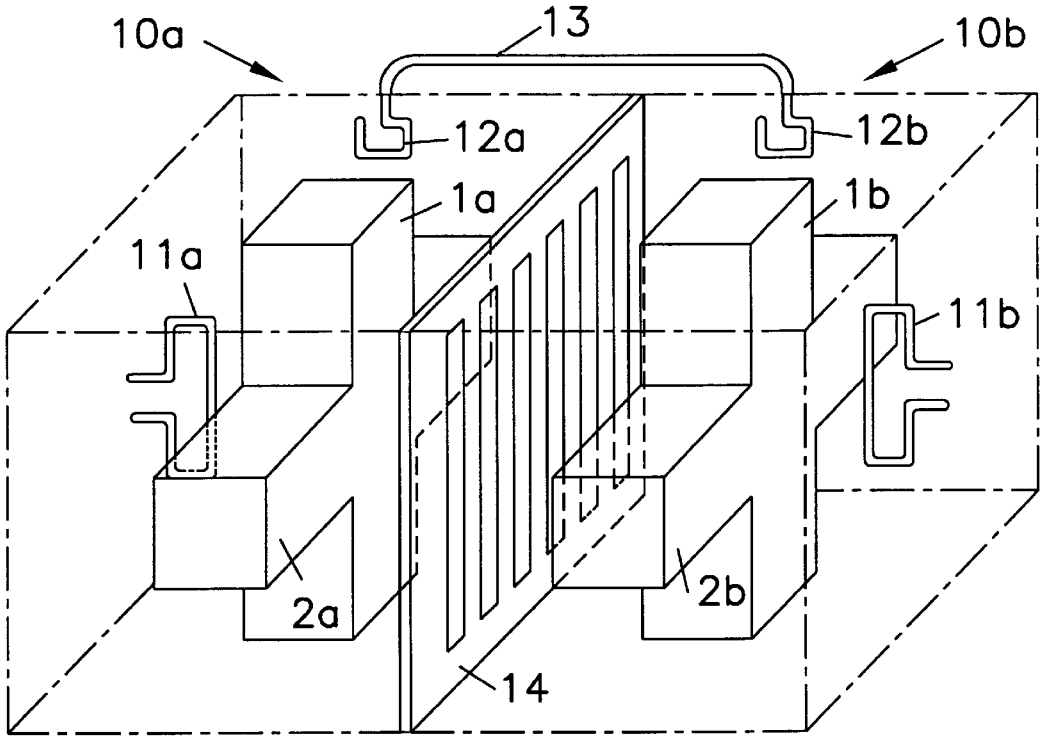
FIG. 21 PRIOR ART
FIG. 21 is a perspective view of a conventional dielectric filter.
Figure 22:
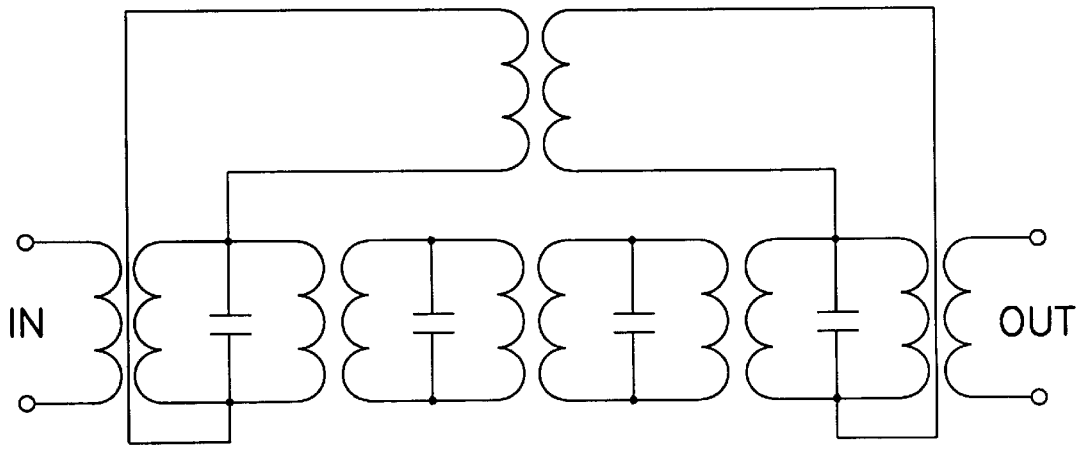
FIG. 22 PRIOR ART
FIG. 22 is an equivalent circuit diagram of the dielectric filter shown in FIG. 21.

FIG. 20A shows an equivalent circuit diagram of a dielectric filter according to an eighth embodiment of the present invention. In the above described embodiments, an external coupling element is provided which is magnetically coupled with both of the first and the next-stage resonators, or an external coupling element is provided which is magnetically coupled with both resonators disposed at the last stage and the stage immediately before the last stage. In FIG. 20A, there are a first external coupling element which is magnetically coupled with both of the first and the next-stage resonators, and a second external coupling element which is magnetically coupled with the resonators disposed at both the last stage and the stage immediately before the last stage. An external coupling element of the type shown in FIG. 1 or FIG. 5 is provided for the dielectric resonator including the first resonator and the dielectric resonator including the last resonator. FIG. 20A is an equivalent circuit diagram of the dielectric filter and FIGS. 20B to 20E show the characteristics of the filter. When the coupling indicated in FIG. 20A by I and the coupling indicated by O are set to be in phase (indicated by +), two attenuation maximums are generated at the higher-frequency side of the transmission band as shown in FIG. 20B. When the coupling indicated in FIG. 20A by I and the coupling indicated by O are set to be in reverse phase (indicated by −), two attenuation maximums are generated at the lower-frequency side of the transmission band as shown in FIG. 20E. When the coupling I and the coupling O are respectively set to be + and −, or − and +, an attenuation maximum is generated at each of the lower-frequency side and the higher-frequency side of the transmission band as shown in FIGS. 20C and 20D.

Although the present invention has been described in relation to particular embodiments thereof, many other variations and modifications and other uses will become apparent to those skilled in the art. The present invention is not limited by the specific disclosure herein.

What is claimed is:

1. A N-th order dielectric filter, N being a positive integer, comprising:

N resonators, said resonators being electromagnetically coupled with each other successively from a first resonator to an N-th resonator;

an input element electromagnetically coupled with both said first resonator and a second resonator which is electromagnetically coupled with said first resonator, said first and second resonators both being comprised in a respective cross-shaped TM multiple-mode dielectric resonator which comprises at least said first and second resonators;

an output element electromagnetically coupled with said N-th resonator;

whereby an output signal is provided via said output element from said N-th resonator in response to a signal input into said input element;

wherein said input element includes a unitary metal member and said input element is located so that said member simultaneously couples with both of said first and second resonators.

2. A N-th order dielectric filter according to claim 1, wherein said input element has a first portion disposed for being coupled substantially with said first resonator, and a second portion disposed for being coupled substantially with said second resonator.

3. A N-th order dielectric filter according to claim 2, wherein said input element is formed so that the phase of coupling between said first portion and said first resonator, and between said second portion and said second resonator, are the same as that between said first and second resonators.

4. A N-th order dielectric filter according to claim 2, wherein said input element is formed so that the phase of coupling between said first portion and said first resonator, and between said first and second resonators, are opposite to the phase of coupling between said second portion and said second resonator.

5. A N-th order dielectric filter according to claim 1, wherein said input element is formed by a metal plate.

6. A N-th order dielectric filter according to claim 1, wherein said input element is formed by a metal wire.

7. A N-th order dielectric filter according to claim 1 further comprising:

an electroconductive casing in which at least said first and second resonators are located;

a receptacle for establishing connection between said input element and an external input cable;

wherein said input element has a first connecting portion connected to said receptacle, and a second connecting portion connected to a portion of said casing so that said receptacle, said input element and said portion of the casing form a coupling loop.

8. A N-th order dielectric filter according to claim 1, wherein respective distances between said input element and said first and second resonators are adjustable.

9. A N-th order dielectric filter according to claim 2, wherein:

said first portion of said input element is disposed a first respective distance from said first resonator; and said second portion of said input element is disposed a second respective distance from said second resonator.

10. A N-th order dielectric filter, wherein N is a positive integer, comprising:

N resonators, said resonators being electromagnetically coupled with each other successively from a first resonator to an N-th resonator;

an input element electromagnetically coupled with said first resonator;

an output element electromagnetically coupled with both said N-th resonator and with an (N-1)-th resonator which is electromagnetically coupled with said N-th resonator, said N-th and (N-1)-th resonators both being comprised in a respective cross-shaped TM multiple-mode dielectric resonator which comprises at least said N-th and (N-1)-th resonators;

wherein an output signal is provided via said output element from said N-th resonator in response to a signal input into said input element;

wherein said output element includes a unitary metal member and said output element is located so that said member simultaneously couples with both of said Nth and (N-1)th resonators.

11. A N-th order dielectric filter according to claim 10, wherein said output element has a first portion disposed for being coupled substantially with said N-th resonator, and a second portion disposed for being coupled substantially with said (N-1)th resonator.

12. A N-th order dielectric filter according to claim 11, wherein said output element is formed so that the phase of coupling between said first portion and said Nth resonator, and between said second portion and said (N-1)th resonator, are the same as that between said Nth and (N-1)th resonators.

13. A N-th order dielectric filter according to claim 11, wherein said output element is formed so that the phase of coupling between said first portion and said Nth resonator, and between said Nth and (N-1)th resonators, are opposite to the phase of coupling between said second portion and said (N-1)th resonator.

14. A N-th order dielectric filter according to claim 10, wherein said output element is formed by a metal plate.

15. A N-th order dielectric filter according to claim 10, wherein said output element is formed by a metal wire.

16. A N-th order dielectric filter according to claim 10 further comprising:

an electroconductive casing in which at least said Nth and (N-1)th resonators are located;

a receptacle for establishing connection between said output element and an external output cable;

wherein said output element has a first connecting portion connected to said receptacle, and a second connecting portion connected to a portion of said casing so that said receptacle, said output element and said portion of the casing form a coupling loop.

17. A N-th order dielectric filter according to claim 10; wherein respective distances between said output element and said N-th and (N-1)-th resonators are adjustable.

18. A N-th order dielectric filter according to claim 11 wherein:

said first portion of said output element is disposed a respective first distance from said Nth resonator; and said second portion of said output element is disposed a respective second distance from said (N-1)th resonator.

19. A N-th order dielectric filter according to claim 1, wherein said output element is further electromagnetically coupled with an (N-1)-th resonator which is electromagnetically coupled with said N-th resonator.

20. A dielectric filter comprising:

an N-th order first dielectric filter, N being a positive integer, having:

N resonators, said resonators being electromagnetically coupled with each other successively from a first resonator to a N-th resonator so that an output signal is provided from said N-th resonator in response to an input signal input into said first resonator;

an input element for receiving and inputting said input signal, said input element being electromagnetically coupled with both said first resonator and a second resonator, said first and second resonators both being comprised in a respective cross-shaped TM multiple-mode dielectric resonator which comprises at least said first and second resonators, said input element including a unitary metal member and said input element being located so that said member simultaneously couples with both of said first and second resonators;

a M-th order second dielectric filter, M being a positive integer, having:

M resonators, said M resonators being electromagnetically coupled with each other successively from a first resonator to a M-th resonator so that an output signal is provided from said first resonator of said M resonators in response to an input signal input into said M-th resonator;

an output element for receiving and outputting said output signal from said first resonator;

an interface element which is operable for both inputting a signal to and outputting a signal from said dielectric filter, said interface element being electromagnetically coupled with said N-th resonator, with an (N-1)th resonator, with said M-th resonator, and with an (M-1) th resonator.

21. A dielectric filter according to claim 20, wherein said dielectric filter is an antenna duplexer and said interface element is for being connected to an antenna.

22. A dielectric filter according to claim 1, wherein said second resonator and said N-th resonator are the same resonator.

23. A dielectric filter according to claim 10, wherein said first resonator and said (N-1)th resonator are the same resonator.

24. A N-th order dielectric filter according to claim 8, wherein said respective distances are adjustable by adjusting an angle defined by said input element and said first and second resonators.

25. A N-th order dielectric filter according to claim 9, wherein said first and second distances are equal.

26. A N-th order dielectric filter according to claim 9, wherein said first and second distances are unequal.

27. A N-th order dielectric filter according to claim 9, wherein said first and second distances are adjustable in response to a shape of said input element.

28. A N-th order dielectric filter according to claim 17, wherein said respective distances are adjustable adjusting an angle defined by said output element and said N-th and (N-1)-th resonators.

29. A N-th order dielectric filter according to claim 18, wherein said first and second distances are equal.

30. A N-th order dielectric filter according to claim 18, wherein said first and second distances are unequal.

31. A N-th order dielectric filter according to claim 18, wherein said first and second distances are adjustable in response to a shape of said output element.

32. A N-th order dielectric filter according to claim 20, wherein said M-th and (M-1)-th resonators are both comprised in a cross-shaped TM multiple mode dielectric resonator which comprises at least said M-th and (M-1)-th resonators.

* * * * *